US007942021B2

(12) United States Patent
Stingel

(10) Patent No.: US 7,942,021 B2
(45) Date of Patent: May 17, 2011

(54) CAM ASSEMBLY PART AND KNITTING MACHINE

(75) Inventor: Uwe Stingel, Messstetten (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/633,525

(22) Filed: Dec. 8, 2009

(65) Prior Publication Data

US 2010/0147034 A1 Jun. 17, 2010

(30) Foreign Application Priority Data

Dec. 11, 2008 (EP) ..... 08171383

(51) Int. Cl.
*D04B 15/32* (2006.01)

(52) U.S. Cl. ..... 66/78

(58) Field of Classification Search ..... 66/54, 27, 66/121, 123, 78
See application file for complete search history.

(56) References Cited

U.S. PATENT DOCUMENTS

| | | | | |
|---|---|---|---|---|
| 1,220,918 | A * | 3/1917 | Wilcomb | 66/54 |
| 3,882,694 | A * | 5/1975 | Stepanek et al. | 66/54 |
| 4,048,817 | A * | 9/1977 | Bianchi | 66/57 |
| 5,182,927 | A | 2/1993 | Pernick | |
| 5,275,023 | A | 1/1994 | Schindler | |
| 5,881,571 | A * | 3/1999 | Reester | 66/54 |
| 6,237,371 | B1 * | 5/2001 | Hsieh | 66/57 |
| 6,810,695 | B1 * | 11/2004 | Wang | 66/57 |
| 2002/0104333 | A1 | 8/2002 | Caselli | |

FOREIGN PATENT DOCUMENTS

| | | |
|---|---|---|
| DE | 4115198 | 11/1991 |
| EP | 0314062 | 3/1989 |
| GB | 843648 | 9/1960 |

* cited by examiner

*Primary Examiner* — Danny Worrell
(74) *Attorney, Agent, or Firm* — Fitch, Even, Tabin & Flannery; Norman N. Kunitz

(57) ABSTRACT

A needle cam assembly is provided in a circular knitting machine or a flat-bed knitting machine, said needle cam assembly allowing an adjustment of at least one cam assembly part with respect to at least one other cam assembly part. As a result of this, the timing of the closing and opening of the inside space of the hook of the slider needle can be adjusted relative to the timing of the retraction of the slider needle and can be set as needed. This measure may be utilized to increase the knitting quality and operational safety of a knitting machine that has been loaded with slider needles.

9 Claims, 3 Drawing Sheets

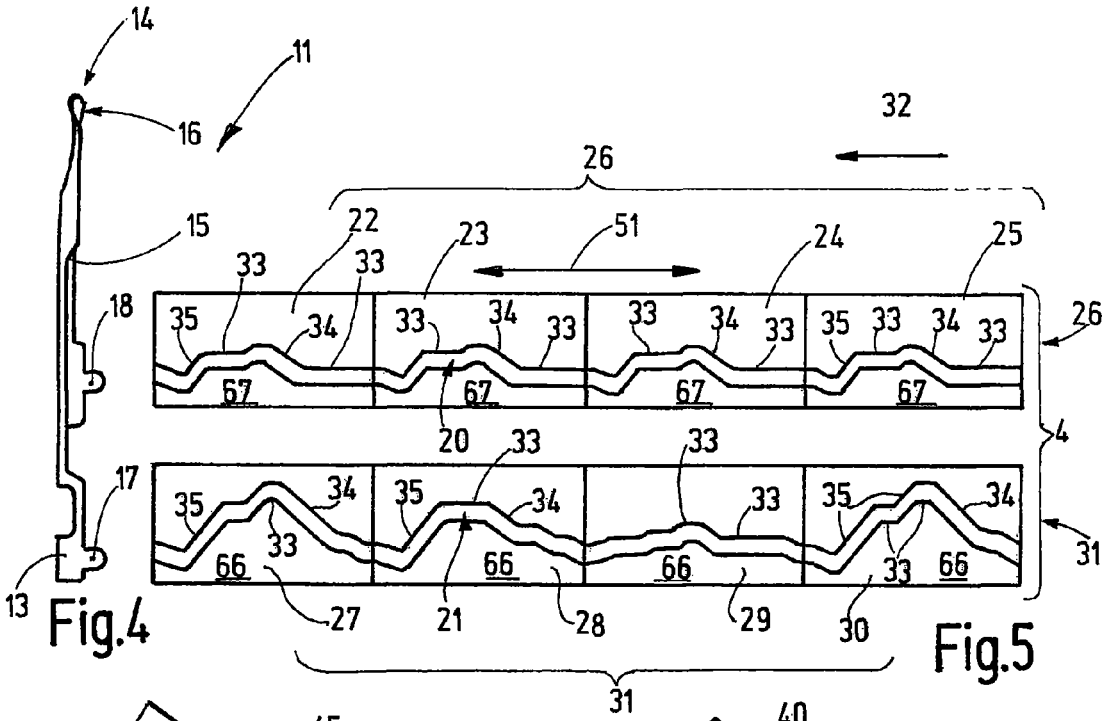
Fig.4
Fig.5
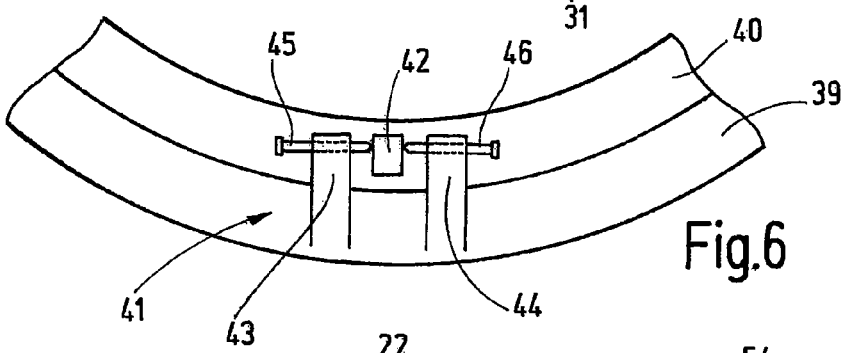
Fig.6
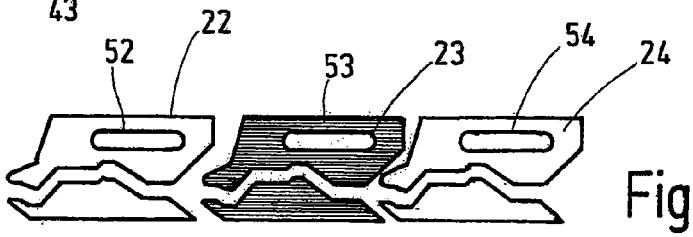
Fig.7
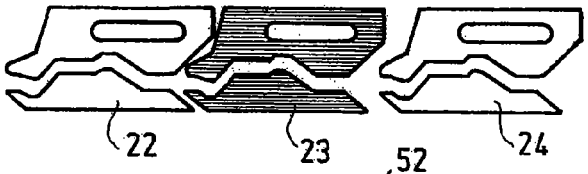
Fig.8
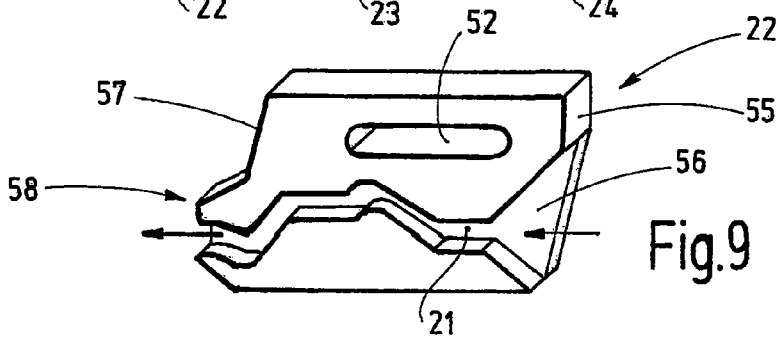
Fig.9

CAM ASSEMBLY PART AND KNITTING MACHINE

CROSS-REFERENCE TO RELATED APPLICATION

This application claims the benefit of foreign priority under 35 U.S.C. §119 based on European Patent application No. 08 171 383.6, filed Dec. 11, 2008, the entire disclosure of which application is hereby incorporated by reference.

BACKGROUND OF THE INVENTION

The invention relates to a cam assembly part for a knitting machine as well as to a knitting machine with slider needles.

Knitting machines are frequently loaded with latch-type needles that comprise a latch that can be freely pivoted back and forth in the vicinity of the hook. The movement of the latch results, e.g., from the movement of the needle and due to the action of the thread on the latch.

In addition, slider needles have been known that comprise a slider, instead of the hook, for controlled closing. This slider is moved alongside the needle body toward the hook and away therefrom in order to close or clear the inside space of the hook. The movement of the slider, as well as the movement of the needle, is controlled by guide paths in the so-called cam assemblies. The shape, in particular the slope of the guide surfaces of the guide paths—in conjunction with the relative movement of the needle/cam assembly—causes the longitudinal shift of the needle body or the slider. These movements are controlled by the appropriate configuration of the guide cams in the cam assembly or the cam assemblies, whereby one guide curve is in abutment with a foot of the needle body and another guide curve is in abutment with a foot of a slider.

When knitting plaited goods, the needles must catch and knit a base thread and, in addition, another thread. For example, the base thread consists of cotton and the other thread consists of an elastic material such as, for example, elastane. In so doing, it must be ensured that both threads that have been picked up by the hook are enclosed in the inside space of the hook in a timely and secure manner and are not able to escape therefrom again.

To accomplish this, German published patent application DE 41 15 198 A1 suggests a special embodiment of the surface of the slider that faces the inside space of the hook.

When slider needles are manufactured, it cannot always be seen for what yarns and materials the slider needle will actually be used on site. The objective is to be able to provide the slider needles for a large number of different yarn qualities or to ensure that the knitting process proceeds reliably with slider needles, even under more difficult conditions, namely, for example, that the production of plaited goods proceeds reliably.

Considering this, it is the object of the invention to provide an option for the improved use of slider needles in knitting machines.

SUMMARY OF THE INVENTION

The above object is achieved according to a first aspect of the invention with the cam assembly part in accordance with claim 1 and, alternatively, according to a second aspect of the invention with the knitting machine in accordance with claim 7.

The cam assembly part in accordance with the invention is disposed to control a foot of a slider needle. Preferably, the foot is a slider foot. Said slider foot controls the movement of the slider. Alternatively, the foot may be a needle foot that controls the movement of the needle. The cam assembly part in accordance with the invention comprises adjustable fastening means or is connected to an adjustment means that allows the adjustment of the position of the cam assembly part in one adjustment direction. Preferably, the adjustment direction is transverse to the longitudinal direction of the needle and is thus also oriented transversely to the longitudinal direction of the slider. Preferably, this transverse direction coincides with the direction of relative movement between the needle cam and the needle bed.

Preferably, the cam assembly of the knitting machine comprises a cam assembly part for the control of the slider and an additional cam assembly part for the control of the movement of the needle. Inasmuch as at least one of the two cam assembly parts is provided with an adjustable fastening means, said parts can be adjusted relative to each other in the above-explained adjustment direction. As a result of this, the timing for closing the slider can be precisely fine-tuned. Adjustments are possible for different thread qualities, thread thicknesses, knitting situations, couliering settings and operating speeds.

The cam assembly part comprises a base body with at least one guide path (preferably, only one guide path for the foot of the slider or the needle). The guide path may comprise rounded, straight, arcuate, ascending or descending sections. These terms relate to the direction of the relative movement between the knitting cam assembly and the needle bed. Preferably, one cam assembly part has at least one ascending and one descending section in order to control a back-and-forth movement of the needle or the slider. Preferably, the guide path of a cam assembly part comprises only a back-and-forth movement of the slider or of the needle.

In order to adjust the cam assembly part in adjustment direction, the fastening means may be an elongated hole extending in adjustment direction. A screw extending through the elongated hole may be used to clamp the cam assembly part to a carrier. If the screw is slightly loosened, the cam assembly part can be moved in and against the adjustment direction. Considering this embodiment, it may be practical to provide one end of the cam assembly part with a recess that is delimited, e.g., by two opposing converging surfaces and to provide the other end with a projection that fits with play into such a recess. In this context, "ends" are understood to mean the end surfaces of the cam assembly part facing toward and away from the adjustment direction. As a result of the mentioned measure, adjacent cam assembly parts come into engagement with each other so that the needle feet, when transitioning from one cam assembly part to the next cam assembly part encounter an essentially smooth transition, i.e., independent of the adjustment of the individual cam assembly part. This adjustment is influenced by the distance of adjacent cam assembly parts from each other.

In particular in the case of circular knitting machines, it is also possible and practical to arrange the cam assembly parts intended for adjustment on a common carrier that, for example, is arranged so as to be rotatable relative to a axis of rotation defined by the needle bed. The needle bed may be a knitting cylinder or a dial, these being driven so as to rotate about the axis of rotation. An adjustment of the slider cam assembly relative to the needle cam assembly is achieved by a minimal rotational adjustment around the axis of rotation. As a result of this, the timing between driving-out and retraction of the slider and the needle body is changed. The arrangement of the slider cam assembly on an annular carrier that is shared by all the cam assembly parts allows the simple adjustment of all the cam assembly parts supported by the carrier by appropriate positioning of the carrier. In this case, the needle cam assembly and the slider cam assembly are stationarily arranged when the knitting machine is in operation.

Alternatively, the knitting machine may also be a flat-bed knitting machine. In this case the needle bed is not curved around an axis of rotation but is straight and arranged in a stationary manner. The path of the—in this case movably supported—knitting cam assembly is a linear path. The knitting cam assembly is moved back and forth in a direction transverse to the slider needles in order to successively drive out and retract the slider needles, and, in so doing, also control their sliders. The needle cam assembly comprises an adjustable cam assembly part for the knitting needles and/or an adjustable cam assembly part for the sliders. The relative adjustment of a cam assembly part relative to the other cam assembly part in view of the direction of movement, i.e., transverse to the needles, changes—as mentioned above—in particular the time for closing the slider needles so that the course of movement of said slider needles can be optimized. The adjustment direction may be at a right angle or at an acute angle with respect to the longitudinal direction of the needles. The slider needles move through the guide paths of the cam assembly of flat-bed knitting machines in alternating direction. Therefore, the cam adjustment is possible as a function of the direction of movement of the carriage during the knitting operation.

Additional details of advantageous embodiments of the invention are obvious from the drawings, the description or the claims. The description is restricted to essential aspects of the invention and miscellaneous situations. The drawings should be referred to as being supplementary, and disclose additional details.

BRIEF DESCRIPTION OF THE DRAWINGS

FIG. 4 is a general representation of a slider needle.

FIG. 5 is a general view of the cam assembly for the slider needle in accordance with FIG. 4.

FIG. 6 is a detail of a plan view of a slider cam assembly adjustment device.

FIG. 7 is a general representation of a slider cam assembly, in a first adjustment position.

FIG. 8 is a general representation of the slider cam assembly in accordance with FIG. 7, in a second adjustment position.

FIG. 9 is a perspective general representation of a cam assembly part of the slider cam assembly in accordance with FIGS. 7 and 8.

DETAILED DESCRIPTION OF THE INVENTION

Figure 1:
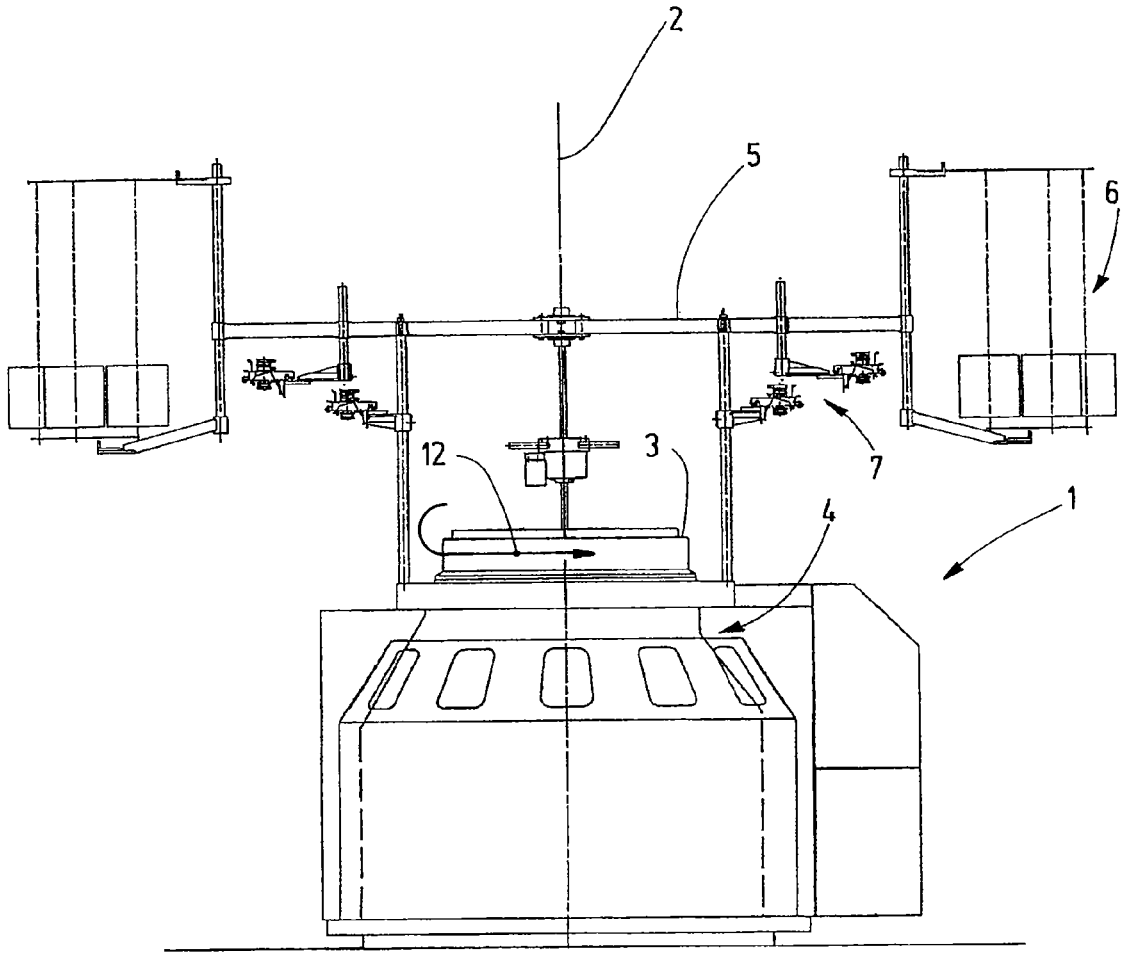
FIG. 1 is a schematized illustration of a circular knitting machine.

FIG. 1 shows a circular knitting machine 1 that comprises a knitting cylinder 3 that is supported so as to be rotatable about a vertical axis of rotation 2. Said knitting cylinder is circumscribed by a knitting cam assembly 4 that is only shown schematically and is also arranged so as to be concentric to the axis of rotation 2. The knitting cylinder 3 forms an annular needle bed with needle channels that are parallel to each other. A frame 5 held on the machine supports yarn spools 6 and thread feeder devices 7 that are disposed to feed threads to the slider needles that are seated in the needle channels of the knitting cylinder 3. The not specifically illustrated needle channels are arranged vertically with respect to the outside circumference of the knitting cylinder 3 parallel to the axis of rotation 2.

Figure 2:
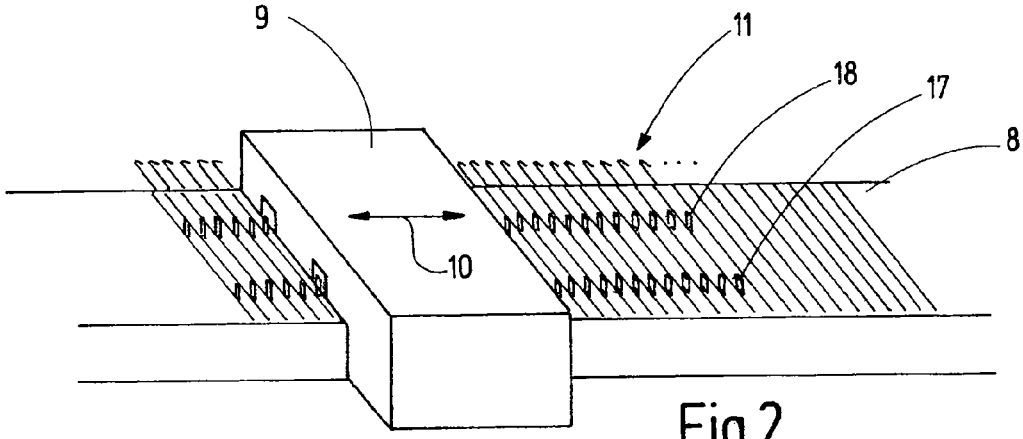
FIG. 2 is a schematized perspective illustration of the needle bed and the cam assembly of a flat-bed knitting machine.

In contrast, the needle bed of a flat-bed knitting machine is linearly elongated. FIG. 2 shows, with reference to such a flat-bed knitting machine, a schematic illustration of a straight needle bed 8 and a movable knitting cam assembly 9. In order to perform a knitting operation, the knitting cam assembly 9 is moved back and forth transversely to the slider needles 11 in the direction of the arrow 10. As opposed to this, considering the circular knitting machine 1 in accordance with FIG. 1, the knitting cam assembly 4 is in inoperative position while the knitting cylinder 3 rotates about the axis of rotation 2, as is indicated by an arrow 12.

Considering the circular knitting machine 1 as in FIG. 1, as well as the flat-bed knitting machine as in FIG. 2, each of the slider needles 11 has a base body 13 which is provided with a hook 14 on one end. A slider 15 is supported in or on the base body 13 so as to be slidable in longitudinal direction of the needle, in which case the end 16 of the slider facing the hook 14—as needed—is used for closing or opening the inside space of the hook defined by the hook 14. To do so, the slider 15 can be slid toward the hook 14 and away from said hook, whereby the end 16 covers the tip of the hook 14 in closed position and is removed from the tip of the hook 14 in clearing position, and is optionally retracted into an inside space of the base body 13.

In order to achieve the longitudinal movement of the base body 13 and of the slider 15, the base body is provided with a needle foot 17 and the slider is provided with a slider foot 18. If the base body 13 and the slider 15 are configured as flat sheet metal pieces, as is preferably the case, the needle foot 17 and the slider foot 18 are extensions that project beyond the upper side of the needle or the upper side of the slider. The needle foot 17 and the slider foot 18 move in guide paths of the knitting cam assembly 4 or 9, said cam assembly being schematically shown in its view radially toward the outside, i.e., with a view on its guide paths 20, 21. The knitting cam assemblies 8 and/or 9 comprise a slider cam assembly 26 and a needle cam assembly 31.

Considering a circular knitting machine, each guide path 20, 21 preferably extends over several cam assembly parts that, together, form the knitting cam assembly 4. The guide path 20 for the slider foot 18 extends in the base body 67 and is formed by several cam assembly parts 22, 23, 24, 25, as well as by additional, not shown, cam assembly parts that—in the case of the circular knitting machine 1—complete each other in a ring circumscribing the knitting cylinder 3 and is formed by these cam assembly parts. These cam assembly parts 22 through 25 (as well as the additional, not illustrated, cam parts of said ring) form the slider cam assembly 26.

The guide path 21 for the needle foot 17 extends in the base body 66 of the cam assembly parts 27, 28, 29, 30 (as well as additional, not illustrated, cam assembly parts), said cam assembly parts—in the case of the circular knitting machine 1—extending with the illustrated cam assembly parts 27 through 30 toward a ring that circumscribes and is concentric to the knitting cylinder 3 and, together, forming the needle cam assembly 31.

In the case of the flat-bed knitting machine, the knitting cam assembly 9 comprises, respectively, only one cam assembly part 22 (slider cam assembly part) and 27 (needle cam assembly part) or, optionally, a few cam assembly parts 22, 23, 24; 27, 28, 29 arranged next to each other in a row, said cam assembly parts having guide paths 20, 21.

In FIG. 5, an arrow 32 illustrates the relative movement between the slider needles 11 and the knitting cam assembly 4. Due to the rotation of the knitting cylinder 3, the feet of the slider needle 11 move along in the guide paths 20, 21 in the direction of the arrow 32. In so doing, said feet follow the straight path sections 33, as well as the ascending sections 34 and the descending section 35.

Figure 3:
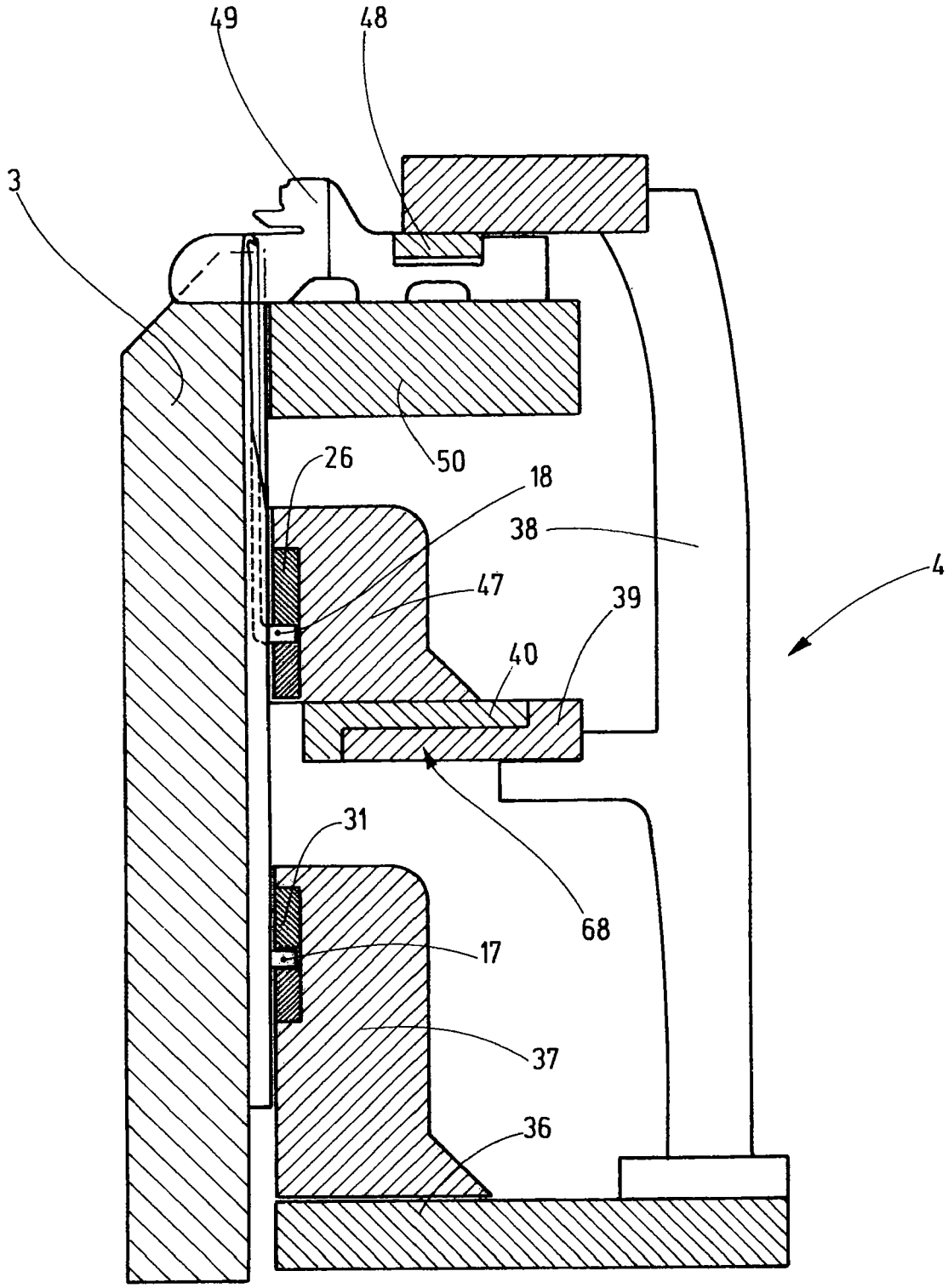
FIG. 3 is a detail of a general representation, vertically in section, of the circular knitting machine in accordance with FIG. 1.

Referring to the circular knitting machine in accordance with FIG. 1, the knitting cylinder 3, as is also obvious—in particular—from FIG. 3, is enclosed by the knitting cam assembly 4. The knitting cam assembly 4 is seated on an annular carrier 36 on which the cam assembly parts 27 through 30 of the needle cam assembly 31 are arranged either directly or indirectly with an interposed intermediate carrier 37.

The carrier 36 may have several supports 38 distributed over its circumference, said supports supporting, for example, an annular carrier 68 arranged concentrically with respect to the knitting cylinder 3, whereby the slider cam assembly 26 is arranged on said annular carrier by means of fastening means. In this case, the carrier 68 may consist of two parts and comprise two rings 39, 40 that can be adjusted relative to each other by rotation. The ring 39 is supported by the support 38 and is thus rigidly connected to the needle cam assembly 31. The ring 40 can at least be minimally rotated relative to the ring 39 and can be locked in various rotary positions. For explanation, reference is made to FIG. 6. As is obvious, the rings 39, 40 that are concentrically nested may be connected to each other via fastening means, for example, in the form of an adjustment mechanism that secure the rings 39, 40 in a non-torsional manner against each other. To do so, the ring 40 may be provided with a projection 42 that extends upward from its upper flat side. The ring 39 may be provided with threaded brackets 43, 44 with aligned bolts 45, 46 that 45, 46 that lock the projection 42 between them. For the purpose of adjustment, an adjustment of the bolts 45, 46 allows a fine-tuned relative rotation of the rings 39, 40.

As is shown by FIG. 3, the ring 40 bears the slider cam assembly 26, for example, by means of individual holders or carriers 47.

Furthermore, the support 38 may support an overall annular sinker cam assembly 48 that is disposed for the control of the movement of the holding-down and knock-over sinkers 49. These are arranged in a sinker ring 50 so as to be radial to the axis of rotation 2 of the circular knitting machine 1, said sinker ring having radial slits for the accommodation of the holding-down and knock-over sinkers 49 and being non-torsionally connected to the upper end of the knitting cylinder 3.

The circular knitting machine 1 described so far operates as follows:

During operation, the knitting cylinder 3 rotates about the axis of rotation 2. In so doing, as shown in FIG. 5, the slider needles 11 are moved in the guide paths 20, 21 of the slider cam assembly 26 and the needle cam assembly 31. As is obvious, the guide paths 20, 21 are slightly different from each other. For example, the needle body 13 is driven farther out due to the ascent 34 of the cam assembly part 30 than the slider 15 due to the ascent 34 of the cam assembly part 25. The cam assembly parts 25 and 30 form a cam assembly part pair through which the slider needle moves at the same time. As a result of this, the inside space of the hook of the slider needle 1 is opened while said needle is being driven out. The straight and descending guide path sections 33, 35 of the two cam assembly parts 25 and 30 cause the inside space of the hook to be closed and the slider needle 11 to be retracted. This is similar with regard to the additional cam assembly part pairs 24, 29 as well as 23, 28 and 22, 27.

In order to be able to better fine-tune the timing of the closing and the opening of the inside space of the hook 14 and of the retracting of the slider needles 11, it may be expedient to adjust the slider cam assembly 26 and the needle cam assembly 31 relative to each other, this being shown by arrow 51 in FIG. 5. The adjustment may be achieved by adjusting the adjustment bolts 45, 46.

It may also be expedient if the needle cam assembly 31 and the slider cam assembly 26 are not adjusted as a whole but in individual cam assembly parts 22, 23, 24. This is illustrated by FIGS. 7 and 8. In this instance, the cam assembly parts 22 and 24 are shown unchanged in their adjustment positions, while the interposed cam assembly part 23 is adjusted to the right in FIG. 7 and adjusted to the left in FIG. 8. In order to fasten the cam assembly parts 22 through 24 to a suitable carrier such as, for example, the holder 47, the cam assembly parts 22 through 24 comprise fastening means in the form of elongated holes 52, 53, 54. A bolt extends through said holes, whereby said bolt can lock the respective cam assembly part 22 through 24 in place. After loosening the bolt, each of the cam assembly parts 22 through 24 can be adjusted in the direction of the arrow 51. The direction of the arrow 51 corresponds to the direction of the arrow 32, i.e., the direction of relative movement between the slider needles 11 and the knitting cam assembly 4.

If the individual cam assembly parts 22 through 24 (as well as other adjoining cam assembly parts that are not shown in FIGS. 7 and 8) are to be adjusted relative to each other, it is expedient to configure the cam assembly parts as will be explained hereinafter with reference to FIG. 9 and to cam assembly part 22, for example.

The end 55 of the cam assembly part 22, where the needles are being operated, has a preferably funnel-shaped recess 56 with two converging surfaces that lead to the guide path 21. As a result of this, the guide path 21 widens in a funnel-like manner on its end. The opposite, other end 57 of the cam assembly part 22 may be provided with a bill-like projection 58 that fits—with play—into the recess 56 of an equally configured cam assembly part. Consequently, independently of the adjustment position of the cam assembly part 22 or 23 in accordance with FIG. 7 or FIG. 8, a smooth, relatively shock-free transition of the slider foot 18 from one cam assembly part to another is ensured.

Due to the feature of individual adjustability of the individual cam assembly parts, it is possible to individually adjust the timing (i.e., the time-specific fine tuning) of the closing movement of the slider and the retraction movement of the needle at each knitting site. Accordingly, the timing can be adjusted by adjusting one cam assembly part on a flat-bed knitting machine.

The concept of relative adjustment of at least one cam assembly part of the slider cam assembly 26 relative to at least one cam assembly part of the needle cam assembly 31 can be implemented on the flat-bed knitting machine in accordance with FIG. 2. Considering, the knitting cam assembly 9 provided there, two guide paths are provided for the slider feet 18 and for the needle feet 17. At least one of the guide paths 20, 21 is implemented by an adjustable cam assembly part, whereby the direction of adjustment coincides with the direction of movement 10 of the knitting cam assembly 9. In so doing, the timing of closing the slider needles in a flat-bed machine can be advantageously adjusted.

A needle cam assembly is provided in a circular knitting machine or a flat-bed knitting machine, said needle cam assembly allowing an adjustment of at least one cam assembly part 22 with respect to at least one other cam assembly part 23. As a result of this, the timing of the closing and opening of the inside space of the hook of the slider needle can be adjusted relative to the timing of the retraction of the slider needle and can be set as needed. This measure may be utilized to increase the knitting quality and operational safety of a knitting machine that has been loaded with slider needles.

It will be appreciated that the above description of the present invention is susceptible to various modifications and changes, and the same are intended to be comprehended within the meaning and range of equivalents of the appended claims.

LIST OF REFERENCE NUMERALS

1 Circular knitting machine
2 Axis of rotation
3 Knitting cylinder/needle bed
4 Knitting cam assembly
5 Frame
6 Yarn spools
7 Thread feeder devices
8 Needle bed
9 Knitting cam assembly
10 Direction of movement
11 Slider needle
12 Arrow
13 Base body
14 Hook
15 Slider
16 End
17 Needle foot
18 Slider foot
20 Guide path for the slider foot 18
21 Guide path for the needle foot 17
22-25 Cam assembly parts
26 Slider cam assembly
27-30 Cam assembly parts
31 Needle cam assembly
32 Arrow
33 Straight guide path sections
34 Ascending guide path sections
35 Descending guide path sections
36 Carrier
37 Intermediate carrier
38 Support
39, 40 Rings
41 Adjustment mechanism
42 Projection
43, 44 Threaded brackets
45, 46 Adjustment bolts
47 Holder
48 Sinker cam assembly
49 holding-down and knocking-over sinkers
50 Sinker ring
51 Arrow
52, 53, 54 Elongated holes
55 End
56 Recess
57 End
58 Projection
66, 67 Base bodies of 27, 22, etc.
68 Carrier

What is claimed is:

1. Knitting machine (1) comprising:
a needle bed for the accommodation of slider needles,
a knitting cam assembly with a needle guide path for the feet of the slider needles and with a slider guide path for the feet of the sliders of the slider needles,
wherein the knitting cam assembly and the needle bed can be moved relative to each other in a driving direction in order to move the slider needles and their sliders in the course of a knitting process,
and further comprising an adjustment device for adjusting at least one section of the slider guide path relative to the needle guide path in driving direction.

2. Knitting machine as in claim 1, wherein the section of the guide path is represented by a cam assembly part comprising:
a base body provided with a guide path for a foot of a slider needle,
fastening means for fastening the base body to a carrier, and
wherein the fastening means is an adjustment means set up for adjusting the position of the cam assembly part in an adjustment direction.

3. Knitting machine as in claim 2, wherein the knitting cam assembly comprises several cam assembly parts that can be adjusted relative to each other in driving direction.

4. Knitting machine as in claim 1, wherein the needle bed is driven so as to be rotatable about an axis of rotation.

5. Knitting machine as in claim 4, wherein the knitting cam assembly comprises a needle cam assembly and a slider cam assembly.

6. Knitting machine as in claim 5, wherein the slider cam assembly is held against the needle cam assembly so as to be adjustable in or against the direction of rotation.

7. Knitting machine as in claim 5, wherein the slider cam assembly comprises a number of cam assembly parts that are arranged in a row and form a ring.

8. Knitting machine as in claim 3, wherein the slider cam assembly comprises a number of cam assembly parts arranged in a row, whereby the mutual distances between said parts can be adjusted.

9. Knitting machine as in claim 1, wherein the needle bed is arranged so as to be stationary.

* * * * *